US008167417B2

(12) United States Patent
Miyata et al.

(10) Patent No.: US 8,167,417 B2
(45) Date of Patent: May 1, 2012

(54) DISCHARGE UNIT AND DISCHARGE APPARATUS

(75) Inventors: Takahiro Miyata, Chigasaki (JP); Masao Murata, Chigasaki (JP); Satoshi Shiba, Chigasaki (JP); Hirofumi Minami, Chigasaki (JP); Seiichi Satou, Chigasaki (JP); Kazuhiro Musha, Chigasaki (JP); Mitsuru Yahagi, Chigasaki (JP); Jyunpei Yuyama, Chigasaki (JP)

(73) Assignee: Ulvac, Inc., Chigasaki-shi (JP)

( * ) Notice: Subject to any disclaimer, the term of this patent is extended or adjusted under 35 U.S.C. 154(b) by 0 days.

(21) Appl. No.: 13/074,633

(22) Filed: Mar. 29, 2011

(65) Prior Publication Data

US 2011/0199441 A1 Aug. 18, 2011

Related U.S. Application Data

(63) Continuation of application No. PCT/JP2009/066758, filed on Sep. 28, 2009.

(30) Foreign Application Priority Data

Sep. 30, 2008 (JP) ..... 2008-254242

(51) Int. Cl.
*B41J 2/17* (2006.01)

(52) U.S. Cl. ..... 347/86; 347/84; 347/85

(58) Field of Classification Search ..... None
See application file for complete search history.

(56) References Cited

U.S. PATENT DOCUMENTS 7,219,704 B2 * 5/2007 Bolle et al. ..... 141/286

FOREIGN PATENT DOCUMENTS

| | | | | |
|---|---|---|---|---|
| JP | 2683187 | B2 | | 11/1997 |
| JP | 3513979 | B2 | | 3/2004 |
| JP | 2005-131939 | A1 | | 5/2005 |
| JP | 2005-262879 | A1 | | 9/2005 |
| JP | 2005262879 | A | * | 9/2005 |
| JP | 2007-245452 | A1 | | 9/2007 |
| JP | 4011560 | B2 | | 11/2007 |
| JP | 2007-326303 | A1 | | 12/2007 |
| WO | WO 2006064040 | A1 | * | 6/2006 |

OTHER PUBLICATIONS

International Search Report for International Application No. PCT/JP2009/066758 dated Oct. 16, 2009.

* cited by examiner

*Primary Examiner* — Matthew Luu
*Assistant Examiner* — Erica Lin
(74) *Attorney, Agent, or Firm* — Kratz, Quintos & Hanson, LLP

(57) ABSTRACT

The backing pressure of an ink tank is controlled. The ink tank is connected to a pressure control apparatus. The pressure control apparatus has first and second check valves. When the internal pressure of the ink tank becomes smaller than that of outside atmosphere by a first predetermined pressure or more, the first check valve is switched into an open state to connect the outside atmosphere and the ink tank. To the contrary, when the internal pressure of the ink tank becomes larger than that of outside atmosphere by a second predetermined pressure or more, the second check valve is switched to an open state to connect the ink tank with the outside atmosphere. Therefore, the internal pressure of the ink tank is controlled precisely enough to stabilize the meniscus.

8 Claims, 4 Drawing Sheets

DISCHARGE UNIT AND DISCHARGE APPARATUS

This application is a continuation of International Application No. PCT/JP2009/66758, filed on Sep. 28, 2009, which claims priority to Japan Patent Application No. 2008-254242, filed on Sep. 30, 2008. The contents of the prior applications are herein incorporated by reference in their entireties.

BACKGROUND OF THE INVENTION

1. Field of the Invention

The present invention generally relates to a liquid drop discharge apparatus for printing by discharging a discharge liquid (ink).

2. Description of the Background Art

In an ink jet discharge apparatus for printing by discharging liquid drops through nozzles, a print head and an ink tank are ordinarily connected by a flow path of exclusive use, so that the ink stored inside the ink tank is fed to the print head through such flow path.

The fed ink is pushed as an ink drop out through a nozzle hole by a pressure wave which is generated by a pressure generating device placed inside the print head. In an on-demand type ink jet head, the pressure generating device is, for instance, an actuator (such as a heater, a piezoelectric element or the like).

At this time, in order that the ink drops may be successfully discharged through the nozzle hole, a surface state of the ink including an ink meniscus at a portion of the nozzle hole, when the print head is not in operation, needs to be stably held. In order to maintain the meniscus, a force that counters a force of when the ink drop spontaneously falls by gravitation must be applied to the ink.

However, the above-mentioned print head of an on-demand type is equipped with a mechanism for ejecting liquid drop, but it is not at all provided with a mechanism for preventing the ink from leaking through the print head when the print head is not in operation. Therefore, a method in which a pressure which can prevent leakage of the ink is applied has been used. This pressure is called herein "backing pressure".

However, the minimum control range of the backing pressure which is required in the ink jet discharge apparatus is around about 10 mm $H_2O$ or less, and besides the difference in pressure from an outside atmosphere is extremely small. Therefore, it is difficult in a system using a conventional vacuum pump or the like to control this pressure range with good precision.

As one of the conventional art techniques for providing the backing pressure, numerous examples in which a net-like porous body is used inside an ink tank are found (see, Patent Documents 1 to 3 mentioned below). It is a technique in which a capillary force, which is generated by fine pores of the porous body when the ink is sucked into the porous body, is utilized as the backing pressure for holding the ink; and it is possible to control the capillary force by dimensions, material, shapes or the like of the fine pores. In this method, however, there are resulting inconveniences such that the composition of the ink is changed due to adsorption of solid component of the ink into the porous body, or the selection of the material of the porous body become restricted by the resistance against the ink.

As another method for providing the backing pressure, there is also an example in which the above-mentioned porous body is not used (see, Patent Document 4 listed below). In this technique, a trap tube in a U-letter shape, communicating with the inside and the outside of the ink tank, is provided inside a substantially airtight ink tank, so that a liquid inside the tube flows to adjust the backing pressure as a pressure difference between the inside and the outside of the ink tank. Although this method is free from the above-explained inconveniences related to the porous body, it has a structure near hermetically-sealed state, so that this method cannot be applied to an apparatus structure in which an ink is fed into an ink tank from the outside.

See, Japan Patent Documents JP-B 2683187, JP-B 3513979, JP-A 2007-326303, and JP-B 4011560.

SUMMARY OF THE INVENTION

The present invention has been accomplished to solve the above-discussed problems, and its object is to provide a technique which can control the backing pressure inside an ink tank without using a porous body and replenish an ink from the outside.

In order to solve the above-mentioned problems, the present invention is directed to a discharge unit comprising an ink tank in which is placed an ink to be discharged to an object to be treated, and a pressure control device connected to the ink tank, wherein the pressure control device comprises first and second flow paths provided between the ink tank and an outside atmosphere, a negative pressure valve which is provided in the first flow path and which is switched to an open state and connects the ink tank with the outside atmosphere when the internal pressure of the ink tank is smaller than that of the outside atmosphere by at least a first predetermined pressure, while being switched to a closed state when it is not in the open state to shield the ink tank from the outside atmosphere, and a positive pressure valve which is provided in the second flow path and which is switched to an open state and connects the ink tank with the outside atmosphere when the pressure of the interior of the ink tank is greater than that of the outside atmosphere by at least a second predetermined pressure, while being switched to a closed state when it is not in the open state to shield the ink tank from the outside atmosphere.

Further, the present invention is directed to the discharge unit, wherein the outside atmosphere is air atmosphere.

Furthermore, the present invention is directed to the discharge unit, wherein the negative pressure valve comprises a valve seat and a valve body, the valve seat is provided with an opening smaller than the valve body, the valve body is arranged on the opening to form a closed state in which the opening is hermetically sealed, and the weight of the valve body is set such that when the pressure in a space under the opening is greater than that in a space above the opening by at least the first preset pressure, the valve body is made to float to form an opened state.

Moreover, the present invention is directed to the discharge unit, wherein the positive pressure valve comprises a valve seat and a valve body; the valve seat is provided with an opening smaller than the valve body; the valve body is arranged on the opening to form a closed state in which the opening is hermetically sealed; and the weight of the valve body is set such that when the pressure in a space under the opening is greater than that in a space above the opening by at least the second preset pressure, the valve body is made to float to form an opened state.

In addition, the present invention is directed to the discharge unit, wherein the negative pressure valve comprises a valve seat, a valve body and a valve spring; the valve seat is provided with an opening smaller than the valve body; the valve body is pressed against a surface of the valve seat-front face by a restoring force of the valve spring to form a closed state in which the opening is hermetically sealed; and the restoring force of the valve spring is set such that when the pressure in a space on the valve seat-rear face side is greater than that of a space on the valve seat-front face side by at least a first predetermined pressure, the valve body leaves the valve body to form an opened state.

Further, the present invention is directed to the discharge unit, wherein the positive pressure valve comprises a valve body and a valve spring; the valve seat is provided with an opening smaller than the valve body; the valve body is pressed against the valve seat-front face by a restoring force of the valve spring to form a closed state in which the opening is hermitically sealed; the restoring force of the valve spring is set such that when the pressure in a space on the valve seat-rear face side is greater than that of a space on the valve seat-front face side by at least a second predetermined pressure, the valve body leaves the valve body to form an opened state.

Furthermore, the present invention is directed to a discharge apparatus, comprising any of the above discharge units and a discharge head connected to the discharge unit, wherein the discharge head is provided with a discharge opening exposed to the outside atmosphere, and the ink placed in the ink tank is fed to the discharge head, and is discharged against the object to be treated from the discharge opening.

The present invention is directed to the discharge apparatus, wherein the discharge opening is located under the ink tank, and the pressure control device controls the internal pressure of the ink tank to be less than the pressure of the outside atmosphere.

Effect of the Invention

Since the backing pressure inside the ink tank is controlled with good precision, leakage of the ink from the discharge opening is prevented, and the meniscus is also stabilized. Since the meniscus is stabilized, a discharged amount of liquid drop from the discharge opening and a liquid drop-discharged state, such as accuracy of landing position or the like, are stabilized. Since no porous body is used in controlling the backing pressure, ink components do not deteriorate.

BRIEF DESCRIPTION OF THE DRAWINGS

FIG. 1(*b*) is a plan view for illustrating the printing apparatus.

FIG. 5(*b*) is a cross-sectional view for illustrating the pressure control device to be used in the second embodiment.

FIG. 6(*b*) is a cross-sectional view for illustrating the pressure control device to be used in the third embodiment.

DETAILED DESCRIPTION OF THE PREFERRED EMBODIMENTS

Best Mode for Carrying Out the Invention

Figure 1A:
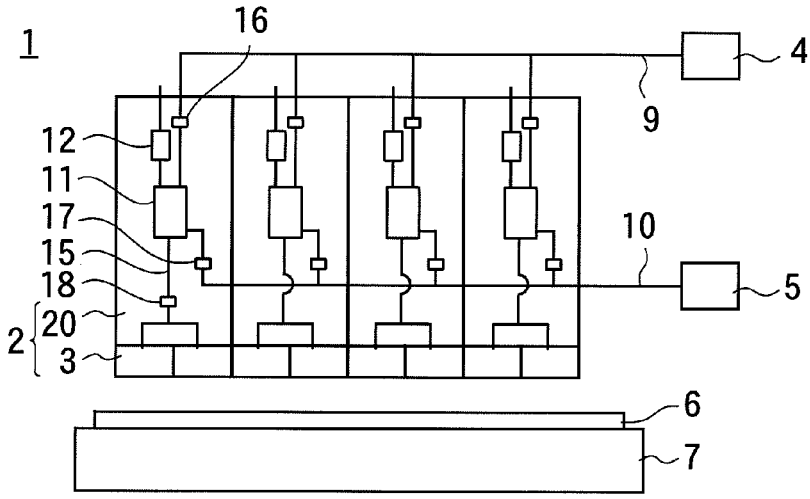
FIG. 1(*a*) is a side view for illustrating a printing apparatus.
Figure 1B:
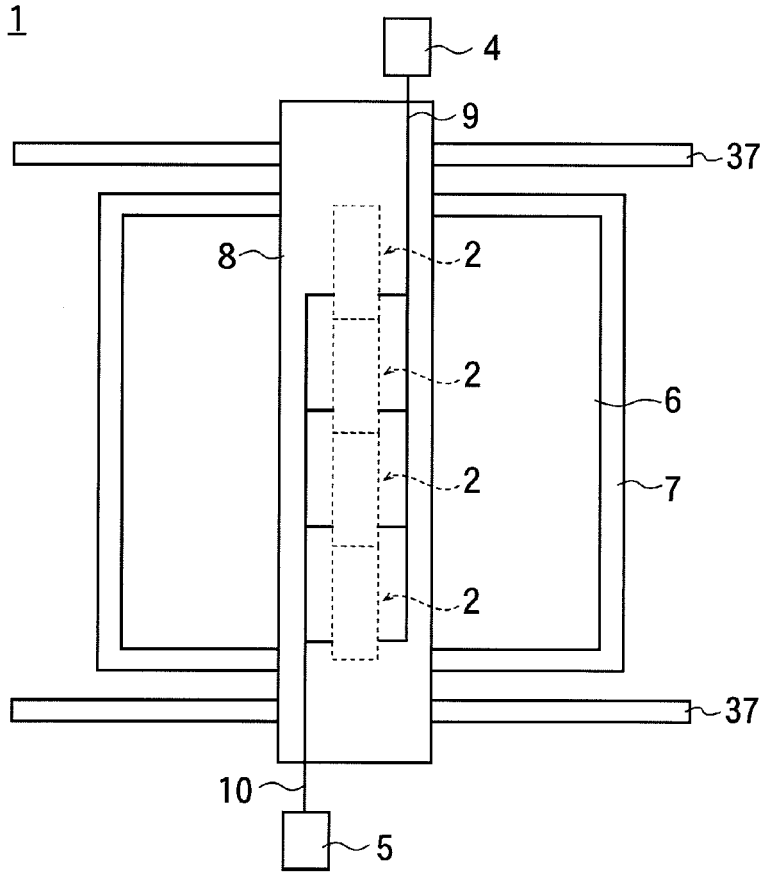

FIGS. 1(*a*) and (*b*) are a side view and a plan view of the printing apparatus. The printing apparatus 1 has a pedestal 7 and a movable arm 8 arranged above the pedestal 7. In FIG. 1(*a*), the movable arm 8 is omitted.

Rails 37 are extended along the sides of the pedestal 7, and the movable arm 8 reciprocates in the extending directions of the rails 37 by means of a moving unit which is not shown in the drawings.

The movable arm 8 is provided with one or a plurality of discharge devices 2. Each of the discharge devices 2 has its own discharge head 3. A discharge head 3 is provided with a discharge opening which is not shown in the drawings, and the respective discharge openings of the discharge heads 3 are exposed at a bottom face of the movable arm 8.

The height from a front face of the pedestal 7 to the bottom face of the movable arm 8 is set larger than the thickness of a substrate 6 as an object to be treated, and the discharge heads 3 move together with the movable arm 8 above the pedestal 7, without collision with the substrate 6 placed on the pedestal 7.

Each discharge unit 2 has a discharge unit 20 that is connected to a main tank 4 and to a discharge tank 5 respectively through flow paths 9, 10 (such as, pipes or the like).

The discharge unit 3 is connected to the discharge unit 20. Although the number of the discharge heads 3 connected to the discharge unit 20 may be one or more, two discharge heads 3 are connected to a single discharge unit 20 in this embodiment. In addition, the number of the discharge units 20 may be one or more.

Figure 2:
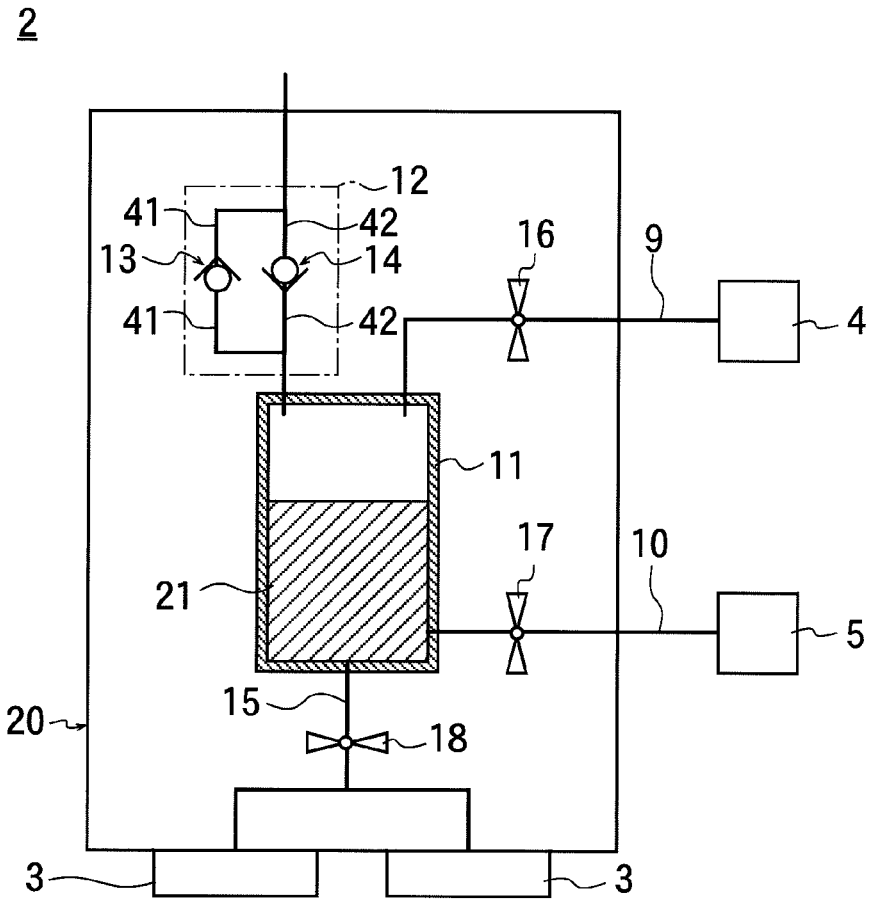
FIG. 2 is a cross-sectional view for illustrating an example of the discharge apparatus according to the present invention.

FIG. 2 is a cross-sectional view illustrating a frame format of the discharge unit 20.

The discharge unit 20 has an ink tank 11, and the flow path 9 connecting the main tank 4 to the discharge unit 20 and the flow path 10 connecting the discharge tank 5 to the discharge unit 20 are respectively connected to the ink tank 11.

These two flow paths 9, 10 are provided with respective cocks 16, 17. When the cock 16 of the flow path 9 between the main tank 4 and the ink tank 11 is switched to an open state, the ink 21 is fed from the main tank 4 to the ink tank 11; when it is switched to a closed state, feeding of the ink 21 is stopped. This ink 21 is also called a discharge liquid.

Additionally, when the cock 17 between the ink tank 11 and the discharge tank 5 is switched to the open state, the ink 21 is discharged from the ink tank 11 to the discharge tank 5; when it is switched to the closed state, discharging of the ink 21 is stopped. In this way, the ink 21 is stored in or discharged from the ink tank 11 by switching the cocks 16, 17.

FIG. 2 shows a state in which the ink 21 is stored in the ink tank 11.

The discharge head 3 is connected to the ink tank 11 through a flow path 15, and a cock 18 is provided in midway through the flow path 15.

The ink tank 11 is located above the discharge head 3, and when the cock 18 between the ink tank 11 and the discharge head 3 is switched to the open state, the ink 21 in the ink tank 11 is fed to the discharge head 3.

Figure 3:
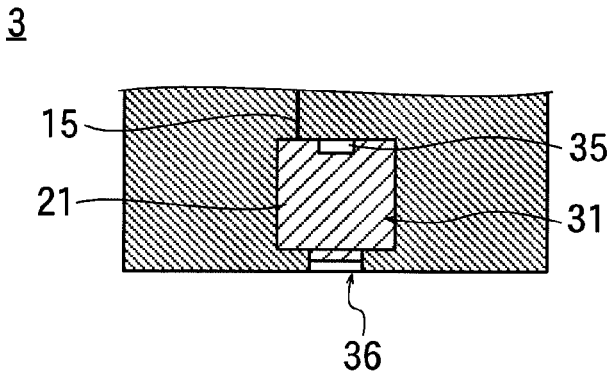
FIG. 3 is a cross-sectional view for illustrating an example of a discharge head.

FIG. 3 is a partially-enlarged cross-sectional view for illustrating the discharge head 3; the discharge head 3 has an ink chamber 31 in which the ink 21 fed from the ink tank 11 is stored.

A discharge opening 36 is connected to the ink chamber 31, and the ink 21 stored in the ink chamber 31 is exposed to an outside atmosphere of the discharge apparatus 1 inside the discharge opening 36. The outside atmosphere is air.

In the ink chamber 31, an actuator 35 (such as a heater, a piezoelectric element or the like) is provided. When an electric current passes through the actuator 35, the actuator 35 is heated or deformed so as to apply a pressing pressure to the ink 21, so that the ink 21 is discharged from the discharge opening 36 and lands upon a substrate 6.

Since the ink tank 11 is located above the discharge head 3, a liquid surface of the ink 21 exposed inside the discharge opening 36 is different in height from a liquid surface of the ink 21 inside the ink tank 11, thereby forming a water head difference.

When the pressure in a space above the liquid surface of the ink 21 inside the ink tank 11 is taken as the internal pressure of the ink tank 11, in order to prevent the ink 21 from leaking from the discharge opening 36 even in a stopped state in which no pressing force is applied from the actuator 35, the internal pressure needs to be controlled by a pressure control device (such as, a valve device 12).

Figure 4:
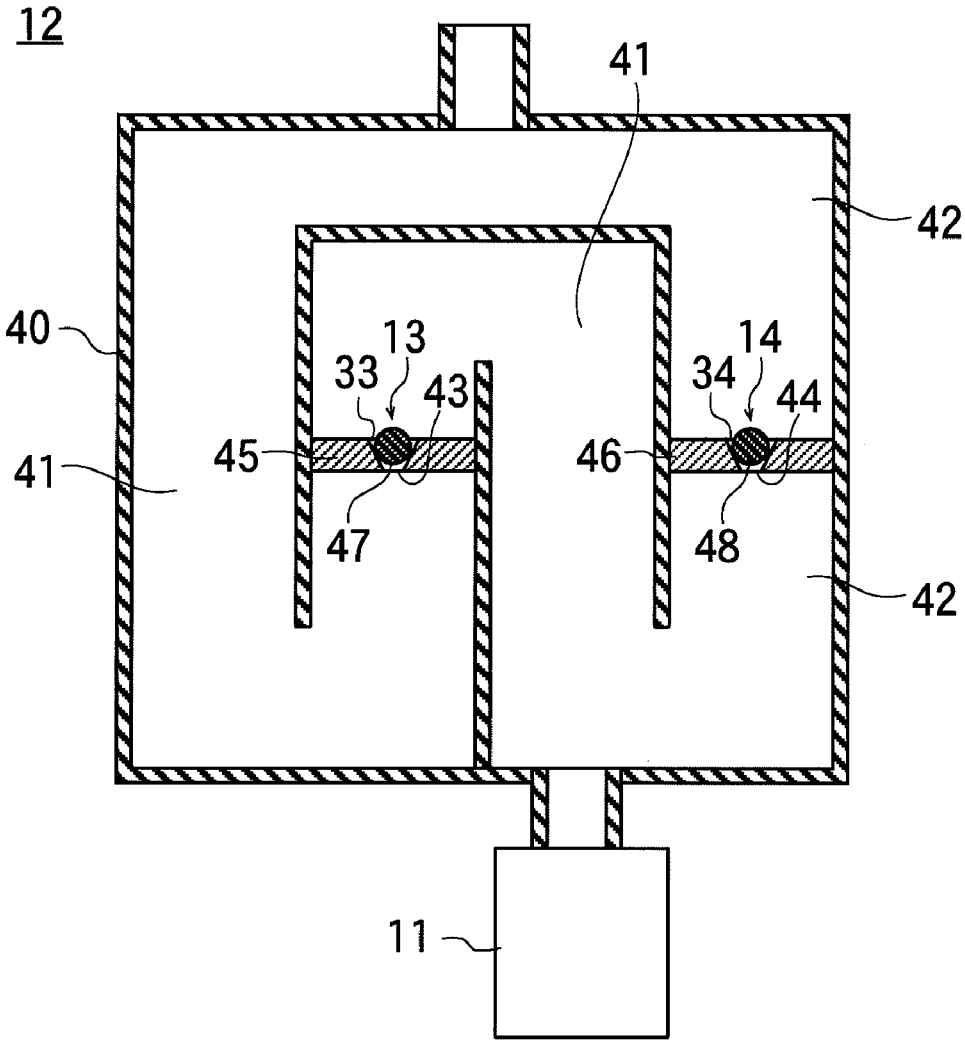
FIG. 4 is a cross-sectional view for illustrating a pressure control device to be used in the first embodiment.

FIG. 4 is an enlarged cross-sectional view of one embodiment of the valve device 12 that has first and second flow paths 41, 42 (such as, pipes or the like), and first and second check valves 13, 14 provided in midstream of the first and second flow paths 41, 42.

Each of one ends of the first and second flow paths 41 and 42 are connected to the ink tank 11, and the other ends are exposed to the same outer atmosphere as the discharge opening 36 (in this embodiment, air). In this embodiment, the first and second flow paths 41, 42 share one end and the other end, but the first and second flow paths 41, 42 may be separated.

The first and second check valves 13, 14 have valve seats 45, 46 and valve bodies 47, 48. The valve seats 45, 46 of the first and second check valves 13, 14 are plates in which through holes 33, 34 are formed, respectively, and fixed at positions in midstream of the first and second flow paths 41, 42, with their side walls being gas-tightly in close contact with inner wall faces of the first and second flow paths 41, 42.

The through holes 33, 34 of the valve seats 45, 46 are in the shape of a funnel in which they become wider upwardly, and narrower downwardly. The valve bodies 47, 48 are granular, and the diameter of which is larger than openings at the lower ends of the through holes 33, 34 and smaller than openings at the upper ends.

The valve bodies 47, 48 are placed on the valve seats 45, 46 such that they interfit with the through holes 33, 34; and inner wall faces of the through holes 33, 34 serve as locating members which surrounds the valve bodies 47, 48, so that the valve bodies 47, 48 are arranged above the connection openings 43, 44 which are the openings at the lower ends of the through holes 33, 34 without being positionally deviated.

The locating members are not particularly limited, so long as they place the valve bodies 47, 48 above the connecting openings 43, 44; two or more supporting rods vertically arranged around the connection opening 43, 44 may make the locating members, or strings hanged immediately above the connecting openings 43, 44 may make the locating members with the valve bodies 47, 48 attached to the strings.

The valve bodies 47, 48 are pressed by their own weights against the peripheries of the connection openings 43, 44 of the valve seats 45, 46 so that the connection openings 43, 44 are sealed with the valve bodies 47, 48 to form a closed state in which upper spaces are separated from lower spaces across the connection openings 43, 44.

Since the valve bodies 47, 48 are exposed to the spaces under the connection openings 43, 44 through the connection openings 43, 44, when the pressure in the spaces under the connection openings 43, 44 is larger than that in the upper spaces, and their pressure difference becomes a predetermined pressure $P_1$ ($P_1$>the weight of the valve body 47, 48/the area of the connection opening 43, 44) or more, the valve body 47, 48 is floated to form a gap, which makes an open state in which the upper space and the lower space are connected across the connection openings 43, 44.

The first and second flow paths 41, 42 bend in midstream; the first check valve 13 is located in a portion of the first flow path 41 where it bends downwardly; and the second check valve 14 is located in a portion of the second flow path 42 where it bends upwardly.

The end portion of the first and second flow paths 41, 42, which is connected to the outer atmosphere, is located above the end portion which is connected to the ink tank 11; therefore, the space above the connection hole 43 of the first check valve 13 is connected to the ink tank 11, and the lower space is connected to the outside atmosphere. To the contrary, the space above the connection hole 44 of the second check valve 14 is connected to the outside atmosphere, and the lower space is connected to the ink tank 11.

When the internal pressure of the ink tank 11 is equal to the outside atmosphere or the pressure difference is less than the predetermined pressure $P_1$, the first and second check valves 13, 14 are closed, so that the ink tank 11 is shielded from the outside atmosphere.

When the internal pressure of the ink tank 11 is lower than that of the outside atmosphere and the pressure difference therebetween is equal to the predetermined pressure $P_1$ or more, the second check valve 14 is in the closed state, and the first check valve 13 is in the open state, so that the ink tank 11 is connected to the outside atmosphere.

Further, when the internal pressure of the ink tank 11 is higher than that of the outside atmosphere and the pressure difference therebetween is the equal to the predetermined pressure $P_1$ or more, the first check valve 13 is in the closed state, and the second check valve 14 is in the open state, so that the ink tank 11 is connected to the outside atmosphere.

In this way, the first check valve 13 serves as the negative pressure valve for adjusting the negative pressure of the ink tank 11, whereas the second check valve 14 serves as the positive pressure valve for adjusting the positive pressure of the ink tank 11; and the pressure difference between the internal pressure of the ink tank 11 and the outside atmosphere is maintained within the predetermined range.

In the above embodiment and the following embodiments, the magnitude of the predetermined pressure $P_1$ at which the first check valve 13 as being the negative pressure valve is changed from a closed state to an open state, and the magnitude of the predetermined pressure $P_1$ at which the second check valve 14 as being the positive pressure valve is changed from the closed state to the open state, may be either be equal or different.

Next, one example of the operation of the discharge apparatus 2 according to the present invention will be explained.

The ink is fed from the main tank 4 to the ink tank 11 with the cock 16 between the main tank 4 and the ink tank 11 being in the open state, and the other cocks 17, 18 being in the closed state. At this time, although the internal pressure of the ink tank 11 rises, the internal pressure is corrected to a pressure in equal measure to the air pressure, by the second check valve 14 being switched to the open state. When a predetermined amount of the ink 21 is contained in the ink tank 11, the cock 16 is closed, and the feeding of the ink 21 from the main tank 4 is stopped.

Then, the cock 17 provided in the flow path 10 between the discharge tank 5 and the ink tank 11 is switched to the open state; the other cocks 16, 18 are switched to the closed state; and a small amount of the ink 21 is discharged from the ink tank 11 in order that the backing pressure, which is the negative pressure relative to the outside atmosphere, is formed inside the ink tank 11 to prevent the ink from leaking. If the internal pressure of the ink tank 11 drops too low and the backing pressure becomes $P_1$ or more, the first check valve 13 is switched to the open state to restore the pressure, so that the backing pressure is corrected to a required value which is less than the predetermined pressure $P_1$.

When the backing pressure of the required value is formed, the cock 17 is closed to stop discharging the ink 21. When the cock 18 between the ink tank 11 and the discharge head 3 is switched to the open state and the other cocks 16, 17 are switched to the closed state, the ink 21 is fed from the ink tank 11 to the discharge head 3; therefore, a discharging process from the discharging head 3 can be performed.

As explained above, since the backing pressure for preventing the ink from leaking is formed inside the ink tank 11, the ink 21 does not leak out from the discharge opening 36 in a stopped state in which no pressing force is applied from the actuator 35.

With the implementation of the liquid drop-discharging process, the amount of the ink 21 inside the ink tank 11 decreased. Although the internal pressure of the ink tank 11 also decreases with the decrease in the ink 21, the first check valve 13 is switched to the open state in response to the decrease in pressure, thereby the backing pressure of the ink tank 11 is succesively corrected.

When the amount of the ink 21 inside the ink tank 11 decreases to less than a predetermined amount, the ink is fed with the cock 16 between the ink tank 11 and the main tank 4 being switched to the open state, whereas the other cocks 17, 18 are in the closed states.

Following the feeding of the ink, the backing pressure is formed as explained above, after which the discharging process is started again.

Meanwhile, in this embodiment and the following embodiments, the pressure of the outside atmosphere is air pressure; and the pressure of the outside atmosphere successively changes, depending on weather phenomena. However, the differential pressure between the outside pressure and the pressure inside the ink tank 11 constantly acts on the valve device 12, so that correction of the differential pressure from the air pressure is included in the backing pressure control, as discussed above.

Although the backing pressure is formed by discharging the ink 21 from the ink tank 11 to the discharge tank 5 in the above explanation, the invention is not limited thereto.

For example, an evacuation pump is connected to the ink tank 11. The ink 21 is fed from the main tank 4 to the ink tank 11; and the internal pressure of the ink tank 11 is increased, then the space above the liquid surface of the ink 21 inside the ink tank 11 is evacuated by the evacuation pump, thereby forming the backing pressure for preventing the ink 21 from leaking.

Although the valve body 47, 48 is not particularly limited, because the minimum pressure control range of the backing pressure in the ink tank 11 is as small as 1 mm $H_2O$, not a heavy grain (such as, a metallic grain) but a light grain (such as, a resin grain, a rubbery grain, a ceramic grain or the like) is used so as to control such a small pressure difference. The weight is, specifically, around 10 g. Further, in order to make the valve bodies 47, 48 lighter, the interior of the grain may be hollow.

In the above-discussed example, the pressures for open valves of the first and second check valves 13, 14 are controlled by the weights of the valve bodies 47, 48, but the present invention is not limited thereto.

Figure 5A:
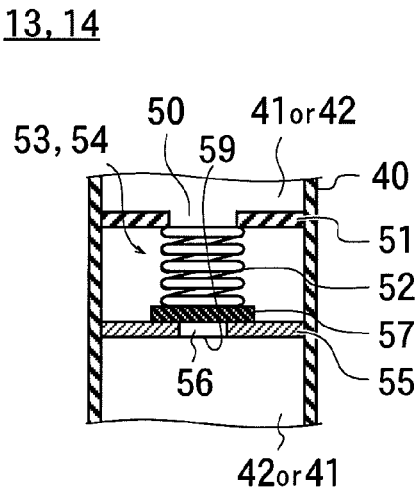
FIG. 5(*a*) is a cross-sectional view for illustrating the pressure control device to be used in the second embodiment.
Figure 5B:
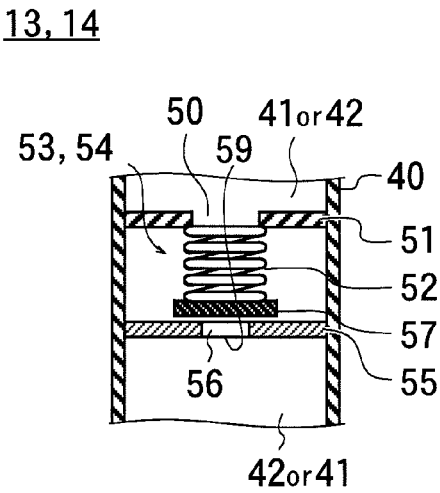
Figure 6A:
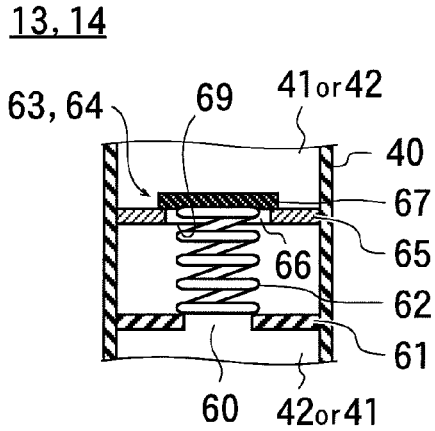
FIG. 6(*a*) is a cross-sectional view for illustrating the pressure control device to be used in the third embodiment.
Figure 6B:
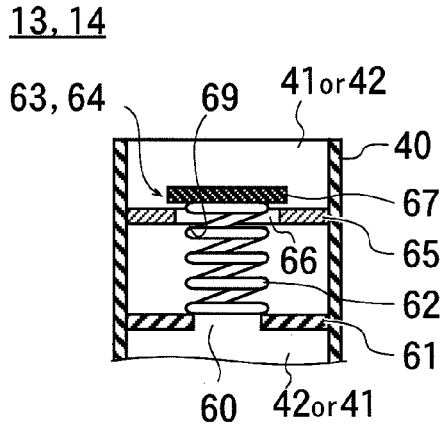

Reference numerals 53, 54 in FIGS. 5(*a*) and (*b*) and reference numerals 63, 64 in FIGS. 6(*a*) and (*b*) denote other embodiments of the first and second check valves to be used in the present invention.

Support members 51, 61 and valve seats 55, 65 are arranged opposed to and spaced apart from each other inside the first and second flow paths 41, 42; and the peripheries of the support members 51, 61 and valve seats 55, 65 are gas-tightly in close contact with and fixed to inner peripheral faces of the first and second flow paths 41, 42.

The first and second check valves 53, 54, 63, 64 have the valve seats 55, 65, the support members 51, 61, valve bodies 57, 67, and valve springs 52, 62. The valve seats 55, 65 are provided with through holes 56, 66 which are smaller than the valve bodies 57, 67, respectively. Reference numerals 59, 69 denote connection openings which are the lower ends of the through holes 56, 66. The support members 51, 61 are also provided with through holes 50, 60.

Therefore, spaces between the support members 51, 61 and the valve seats 55, 65 are connected respectively to the spaces, which are the outside spaces thereof, on the supporting members 51, 61 side and on the valve seats 55, 65 side, inside the first and second flow paths 41, 42, by the through holes 50, 60, 56 and 66.

The valve springs 52, 62 are fixed to the supporting members 51, 61 at one ends. Valve bodies 57, 67 which are larger than the through holes 56 are attached to the other ends of the valve springs 52, 62.

In FIG. 5(*a*), taking a face of the valve seat 55 on the side of the supporting member 51 as a front face, the valve spring 52 and the valve body 57 are located on the front face side of the valve seat 55, and between the valve seat 55, and the support member 51; the valve spring 52 is attached to the supporting member 51 in a compressed state, and the valve body 57 is pressed against the valve seat 55 by a restoring force of the valve spring 52 for returning to an original position, thereby covering the through hole 56.

In FIG. 6(*a*), taking a face of the valve seat 65 which is the other side of a face of the supporting member 61 as a front face, the valve body 67 is arranged on the front face side of the valve seat 65; the valve spring 62 is extended through the through hole 66 of the valve seat 65 with one end fixed to the supporting member 61; and the valve body 67 is pressed against the front face of the valve seat 65 by a restoring force of the extended valve spring 62 for returning to an original position.

In either case shown in FIG. 5(*a*) or case shown in FIG. 6(*a*), the connection openings 59, 69 are hermetically sealed by the valve bodies 57, 67 which are pressed against the front faces of the valve seats 55, 65, so that the spaces on the front face side of the valve seats 55, 65 are switched to the closed state in which the spaces are shielded from a space on the rear face side.

Because the valve bodies 57, 67 are exposed to the space on the rear face sides of the valve seats 55, 65 through the connection openings 59, 69, when the pressure of the spaces on the rear face sides of the valve seats 55, 65 becomes higher than the pressure of the space on the front face side, and a pressure difference therebetween becomes larger than a predetermined pressure $P_2$ ($P_2$>the restoring force of the valve spring 52, 62/the area of the connection opening 59, 69), the valve spring 52 is further compressed (FIG. 5(*b*)), or the valve spring 62 is further extended (FIG. 6(*b*)) and the valve bodies 57, 67 are unstuck from the valve seats 55, 65, so that the spaces on the front face side of the valve seat 55, 65 are switched to the open state in which the spaces are connected with the space on the rear face side.

When the space on the front face side of the valve seat 55, 65 of the first check valve 53, 63 is connected to the ink tank 11, the space on the rear face side is connected to the outside atmosphere; and the space on the front face side of the valve seat 55, 65 of the second check valve 54, 64 is connected to the outside atmosphere and the space of the rear face side is connected to the ink tank 11, the first check valves 53,63 serve as negative valves, and the second check valves 54, 64 serves as positive valves similar to the case of FIG. 4.

Meanwhile, either one of the first and second check valves may be constructed by the check valves 13, 14 as illustrated in FIG. 4, and the other is constructed by the check valves 53, 54, 63, 64 in FIGS. 5 and 6.

Although the internal pressure of the ink tank 11 is not particularly limited, the ink 21 is not normally fed from the ink tank 11 to the discharge head 3 when it is too low; therefore, the internal pressure should be set to a value which does not interrupt the feeding of the ink 21.

Specifically, it is set such that when a value calculated by subtracting the pressure of the outside atmosphere from the internal pressure of the ink tank 11 becomes a preset value in a range of −5 mm $H_2O$ to −100 mm $H_2O$, the first check valves 13, 53, 63 are switched to the open state. Further, the structure and the material of the first check valves 13, 53, 63 are selected in order that the minimum pressure control range is 1 mm $H_2O$.

On the other hand, the second check valves 14, 54, 64 are set to be switched to the open state when the internal pressure of the ink tank 11 becomes larger than the pressure of the outside atmosphere.

What is claimed is:

1. A discharge unit, comprising: an ink tank in which an ink for discharging to an object to be treated is placed; and a pressure control device connected to the ink tank, wherein the pressure control device has:

first and second flow paths being provided between the ink tank and an outside atmosphere;

a negative pressure valve, provided in the first flow path, the negative pressure valve being configured to allow the ink tank to connect to the outside atmosphere when the internal pressure of the ink tank is smaller than the pressure of the outside atmosphere by a first predetermined pressure or more, and configured to shield the ink tank from the outside atmosphere when the internal pressure of the ink tank is not smaller than the pressure of the outside atmosphere by the first predetermined pressure or more; and a positive pressure valve, provided in the second flow path, the positive pressure valve being configured to allow the ink tank to connect to the outside atmosphere when the internal pressure of the ink tank is larger than the pressure of the outside atmosphere by a second predetermined pressure or more, and configured to shield the ink tank from the outside atmosphere when the internal pressure of the ink tank is not larger than the pressure of the outside atmosphere by a second predetermined pressure or more;

wherein a backing pressure inside the ink tank is controlled without using a porous body.

2. The discharge unit as set forth in claim 1, wherein the outside atmosphere is air atmosphere.

3. The discharge unit as set forth in either one of claim 1 or 2, wherein the negative pressure valve has a valve seat and a valve body:

the valve seat being provided with an opening which is smaller than the valve body;

the valve body being arranged on the opening to shield the ink tank from the outside atmosphere by hermetically sealing the opening; and the weight of the valve body is set such that when the pressure in a space under the opening is larger than the pressure in a space above the opening by the first predetermined pressure or more, the valve body floats to connect the ink tank to the outside atmosphere.

4. The discharge unit as set forth in either one of claim 1 or 2, wherein the positive pressure valve has a valve seat and a valve body:

the valve seat being provided with an opening which is smaller than the valve body;

the valve body being arranged on the opening to shield the ink tank from the outside atmosphere by hermetically sealing the opening; and the weight of the valve body is set such that when the pressure in a space under the opening is larger than the pressure in a space above the opening by the second predetermined pressure or more, the valve body floats to connect the ink tank to the outside atmosphere.

5. The discharge unit as set forth in either one of claim 1 or 2, wherein the negative pressure valve has a valve seat, a valve body and a valve spring:

the valve seat being provided with an opening which is smaller than the valve body;

the valve body being pressed against the valve seat-front face by a restoring force of the valve spring to shield the ink tank from the outside atmosphere by hermetically sealing the opening; and the restoring force of the valve spring being set such that when the pressure in a space on the valve seat-rear face side is larger than the pressure of a space on the valve seat-front face side by the first predetermined pressure or more, the valve body unsticks from the valve seat to connect the ink tank to the outside atmosphere.

6. The discharge unit as set forth in either one of claim 1 or 2, wherein the positive pressure valve has a valve seat, a valve body and a valve spring:

the valve seat being provided with an opening which is smaller than the valve body;

the valve body being pressed against the valve seat-front face by a restoring force of the valve spring to shield the ink tank from the outside atmosphere by hermetically sealing the opening; and the restoring force of the valve spring being set such that when the pressure in a space on the valve seat-rear face side is larger than the pressure of a space on the valve seat-front face side by the second predetermined pressure or more, the valve body unsticks from the valve seat to connect the ink tank to the outside atmosphere.

7. A discharge apparatus, comprising:

the discharge unit as set forth in either one of claim 1 or 2; and a discharge head connected to the discharge unit, the discharge head being provided with a discharge opening exposed to the outside atmosphere, wherein the ink contained in the ink tank is fed to the discharge head to be discharged to the object to be treated from the discharge opening.

8. The discharge apparatus as set forth in claim 7, wherein the discharge opening is located under the ink tank; and wherein the pressure control device controls the internal pressure of the ink tank to be less than the pressure of the outside atmosphere.

* * * * *